US005140927A

United States Patent [19]

Tolefson

[11] Patent Number: 5,140,927

[45] Date of Patent: Aug. 25, 1992

[54] MOTION COMPENSATION AND TENSION CONTROL SYSTEM

[75] Inventor: Donald C. Tolefson, Gloucester, Va.

[73] Assignee: Motion Technology, Hampton, Va.

[21] Appl. No.: 636,691

[22] Filed: Jan. 2, 1991

[51] Int. Cl.[5] ..... B63H 21/66

[52] U.S. Cl. ..... 114/244; 114/253; 114/312; 267/70; 254/277; 254/900

[58] Field of Search ..... 114/244, 245, 253, 254, 114/213, 215, 312; 441/24, 25, 26; 267/70, 71, 118; 254/277, 900; 414/139.6, 137.7, 138.2, 138.3, 138.4

[56] References Cited

U.S. PATENT DOCUMENTS

| | | | |
|---|---|---|---|
| 546,788 | 9/1895 | Sheldon | 114/215 |
| 820,464 | 5/1906 | Adam | 318/6 |
| 2,364,901 | 12/1944 | Hicks | 267/70 |
| 3,743,249 | 7/1973 | van Daalen | 254/172 |
| 3,807,334 | 4/1974 | Egeberg | 114/50 |
| 3,856,267 | 12/1974 | Flannelly | 254/183 |
| 4,021,019 | 5/1977 | Sanders | 254/172 |
| 4,107,804 | 8/1978 | Bennett | 441/24 |
| 4,126,298 | 11/1978 | Lub | 254/172 |
| 4,593,885 | 6/1986 | Hackman | 254/277 |
| 4,630,542 | 12/1986 | Peyre | 104/114 |
| 4,724,970 | 2/1988 | Kuhn | 212/147 |

*Primary Examiner*—Sherman D. Basinger
*Attorney, Agent, or Firm*—Wallace J. Nelson

[57] ABSTRACT

A motion compensation and tension control system (MCATS) for a surface vessel overboarding, umbilical cable supported, submersible payload is provided with a housing containing a pair of spaced parallel guide rods attached to oppositely disposed housing end plates. Two identical carriages, slidably disposed on the pair of guide rods, each include two parallel slide tubes rigidly attached by a cross plate and by an axle, with a plurality of sheaves rotatably supported by each axle. Motion of each carriage as a rigid body along the guide rods is elastically restrained by, either extension or compression springs. The surface vessel umbilical cable is received through an opening in one of the end plates, reeved around the two sets of sheaves, and mechanically connected to the other end plate. Wave induced surface vessel motion is transmitted through the umbilical cable and absorbed, or compensated for, by the spring restrained carriage motion before it reaches the submersible payload. Suitable electrical and/or optical connections between the surface vessel and the payload may be made through the umbilical cable.

14 Claims, 3 Drawing Sheets

MOTION COMPENSATION AND TENSION CONTROL SYSTEM

FIELD OF THE INVENTION

This invention relates generally to shock absorbing systems and relates specifically to a motion compensation and tension control system for preventing sudden and destructive tension loads being applied to a ship or buoy mounted cable that supports a submersible payload, and for reducing the motions of the submersible payload.

BACKGROUND OF THE INVENTION

Naval, scientific and commercial marine operations often involve deployment of a submersible payload suspended by a suitable cable or rope extending from an overboarding system on a ship or other surface vessel. Various types of suspension elements, depending upon the mission, include synthetic and wire rope, electromechanical and optomechanical cable, and the like, that may be attached to a suitable ship or surface vessel overboarding system for deployment of a submersible payload. Ship overboarding systems useful in practice of the present invention include cranes, winch and overboarding sheave combinations, as well as A-frame and U-frame overboarding systems. Numerous types of submersible payloads are routinely employed, with the specific payload again depending upon the mission involved. These submersibles include remotely operated vehicles (ROV), with and without cages, conductivity, temperature, density (CTD) scientific instrument assemblages, camera sleds, and the like.

The method of operation for various submersible payloads may involve towing, casting, holding a fixed elevation in the water column or deploying the payload on the ocean floor at a fixed site. In each situation, it is generally desirable to remove, neutralize or, at least, minimize the wave induced motion of the surface vessel from the motions of the submerged payload. Otherwise, induced motions in the submerged payload create difficulties in measuring, viewing, photographing, recording or collecting useful data by the submersible. Also, it is well recognized that ship motion can lead to sudden jerks that result in broken or snapped suspension cables caused by momentary slack development in the cable, followed by sudden removal of the slack, to produce instantaneous stretching and loading of the cable.

Various attempts to isolate submersible payloads from the motion of the surface vessel have included the use of both active and passive motion compensation systems.

Active compensation systems involve paying out, and hauling in, cable in response to motion sensor devices, such as one or more accelerometers attached to the ship or to the overboarding sheave block. This approach requires continuous acceleration and deceleration of the cable winch over time periods of only several seconds duration. Such rapid and reversing actions require drivers or prime movers of large horsepower due to the large inertia of the winching system.

Also, for efficient operations, active systems must be provided with accurate, instantaneous data on either the vertical position or velocity of the ship. This data must be available essentially on a continuous basis and serves as the intelligence for commanded winch rotations. Unfortunately, the accelerometers provide acceleration data only and, to obtain either position or velocity, mathematical integration of the accelerometer signal is required. The mathematical integration leads to difficulties due to lack of knowledge of the initial conditions relative to velocity and/or position, signal error, and effects of outside influences, such as extraneous vibrations of the accelerometer(s) mounting structure and the roll and pitch of the ship.

Passive compensation systems are usually based on the use of air or gas springs to provide a compliant member in the overboarding system. This member may be a bobbing crane boom that holds an overboarding sheave or it may be a ram tensioning type device designed to maintain nearly constant tension on the suspension cable.

The present invention differs from the active and passive motion compensation devices described hereinabove and from any other known motion compensation system.

Accordingly, it is an object of the present invention to provide a new and novel motion compensation and tension control system for a surface vessel supporting a submersible payload.

Another object of the present invention is to provide a motion compensation and tension control system that is positioned between the submerged end of a support cable and a submersible payload.

An additional object of the present invention is a motion compensation and tension control system that essentially isolates a submersible payload from the wave induced motion of the surface ship.

A further object of the present invention is a motion compensation and tension control system that prevents or minimizes wave induced ship motion from moving or disturbing a submersible payload.

SUMMARY OF THE INVENTION

According to the present invention the foregoing and additional objects are attained by providing a ship overboarding system having an umbilical cable extending therefrom and attached to a submersible payload deployed in a body of water via a motion compensation and tension control device supported by the umbilical cable and disposed between the ship and submersible payload. The motion compensation and tension control device includes an elongated rigid housing having a pair of end plate closures and is provided with suitable perforations (not shown) therethrough to permit flooding with sea water when in use. A pair of elongated spaced guide rods extend between and are secured to each of the end plates.

A sheave support carriage is disposed within the housing adjacent each of the end plates. Each of the sheave support carriages is provided with a cross plate that extends substantially across the housing. The elongated spaced guide rods extend through suitable openings provided in each of the cross plates. A pair of elongated slide tubes are secured to each of the cross plates and slidably received by each of the spaced guide rods. An axle member is secured to and transversely disposed between each of the pair of elongated slide tubes. A plurality of spaced sheaves are rotatably disposed on each of the axle members. A plurality of elongated extension springs are disposed between and connected at each end to one of the end plates and one of the cross plates and serve to resist movement of the sheave support carriages toward each other, and to assist in moving the carriages away from each other.

The umbilical cable leading from the ship overboarding system extends through a first one of the end plates and is reeved around each of the plurality of spaced sheaves on oppositely disposed sheave support carriages and mechanically connected to the second end plate. The external housing of the motion compensation and tension control device is positively secured to the submersible payload. Thus, any wave induced motion of the ship causes the umbilical cable to exert an increase or decrease in force on the spaced sheave carriages within the motion compensation and tension control device. Increased force is exerted on the umbilical cable when a wave causes the ship to move in a relatively upward direction and decreased force is exerted on the umbilical cable after the wave crests and the ship moves relatively downward. Sheave carriage movement toward each other, responsive to increased cable force, is resisted by the plurality of springs. Accordingly, the increase in force on the umbilical cable must be sufficient to overcome this spring action in order for the carriages to move toward each other. When the force on the umbilical cable decreases, the springs assist in moving the carriages away from each other. Movement of the sheave carriages pay out or take up the umbilical cable, to thereby dampen or nullify any wave induced ship motion that otherwise would be transmitted to the payload.

The umbilical cable may be an electromechanical or optomechanical cable when electrical or optical connection between the ship and payload is desired, and suitable electrical or optical connection is provided between the mechanically connected umbilical cable and the payload utilization circuitry.

Various modifications of the cable connection between the motion compensating and tension control device and the payload are employed for utilization of the electrical and optical capabilities.

BRIEF DESCRIPTION OF THE DRAWINGS

A more complete appreciation of the invention and many of the attendant advantages thereof will be better understood when considered in connection with the accompanying drawings wherein.

DETAILED DESCRIPTION

Figure 1:
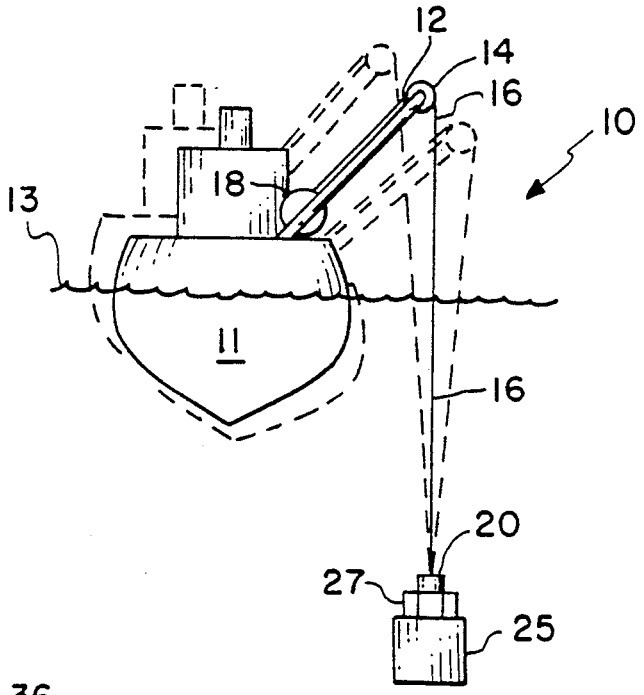
FIG. 1 is a schematic representation of a ship supported crane securing a submersible payload and employing the motion compensation and tension control device of the present invention.

Referring now to the drawings, a motion compensation and tension control system, according to the present invention and as employed for a submersible payload supported by an overboarding assembly on a surface vessel, is schematically shown in FIG. 1 and designated generally by reference numeral 10. As shown therein, a surface vessel or ship 11 on the surface of a body of water 13 is provided with an overboarding crane boom 12 having an end sheave 14 supporting an umbilical cable 16 extending from windless or winch 18. Umbilical cable 16 passing over sheave 14 connects with a motion compensation and tension control unit or device 20 (MCATS) attached to a submersible payload 25. A buoyancy and mass module 27 is supported either by payload 25 or unit 20, or both, and encases a portion of motion compensation and tension control unit 20, as will be further explained hereinafter.

Figure 2:
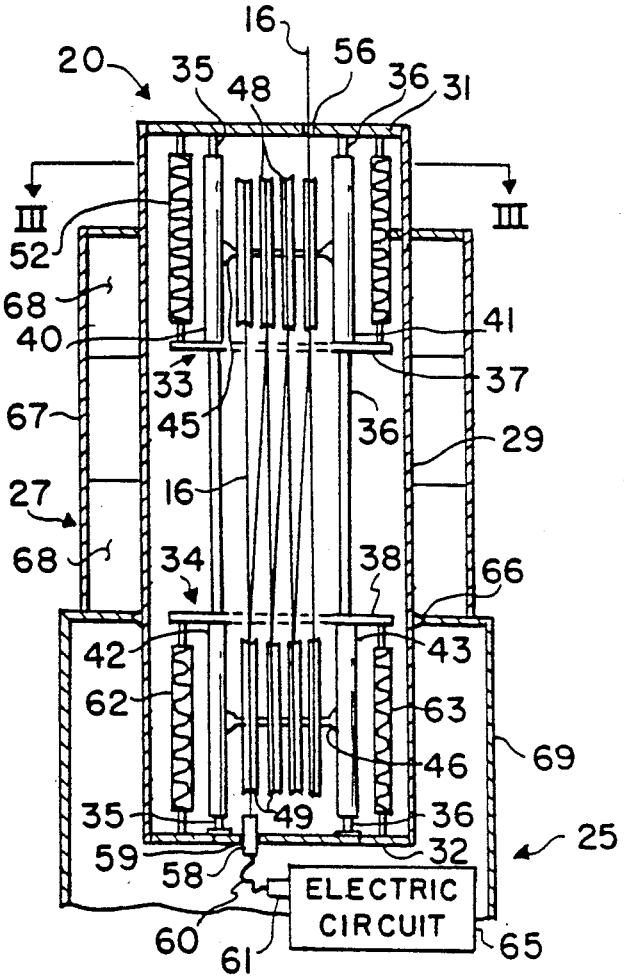
FIG. 2 is part sectional, part schematic representation of the motion compensation and tension control device shown in FIG. 1.
Figure 3:
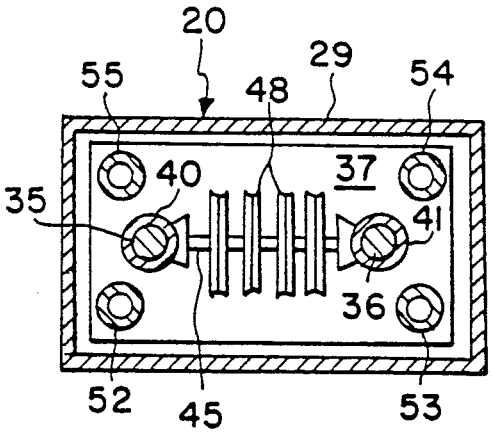
FIG. 3 is a part sectional view of the motion compensation and tension control device shown in FIG. 2 as seen along line III—III of FIG. 2.

Referring now more particularly to FIGS. 2 and 3, motion compensation and tension control unit 20 includes an elongated housing 29 having a pair of end plates 31,32 closing respective opposite ends thereof. A pair of elongated spaced guide rods 35,36 extend between and are welded, or otherwise conventionally secured, to end plates 31,32. A pair of rigid sheave supporting carriages 33,34 are slidable disposed on guide rods 35,36. Carriages 33,34 include respective cross plates 37,38. Each cross plate 37,38 is provided with a pair of integrally secured elongated slide tubes, as designated by reference numerals 40,41 for cross plate 37 and 42,43 for cross plate 38. A pair of axles 45,46 are integrally secured, respectively, between slide tube pair 40,41 and slide tube pair 42,43.

Axle 45 rotatable supports a plurality of spaced rotatable sheaves 48 while axle 46 supports a plurality of rotatable spaced sheaves 49. Although there are four sheaves in each group of sheaves 48,49 in the illustrated embodiment, this number is not fixed and the number, diameter and width of the sheaves employed may vary in different applications.

A plurality of elongated extension coil springs (four in the illustrated preferred embodiment) 52,53,54,55 are disposed between carriage 33 and end plate 31 with the respective ends of each spring being fixedly secured to cross plate 37 and end plate 31. Identical (in number and size) springs are employed between carriage 34 and end plate 32 with only two of these being visible in the drawing and designated by reference numerals 62,63. Spring group 52,53,54,55 and spring group 62,63, (and the two not visible in the drawing) serve to resist movement of carriages 33,34 toward each other while assisting in repelling the carriages away from each other once they have been moved, as will be further explained hereinafter.

Umbilical cable 16 from surface vessel 11 enters end plate 31 through cable opening 56 and is alternately reeved around the first bottom sheave 49, first top sheave 48, second bottom sheave 49, second top sheave 48, etc., before terminating at end plate 32 after being reeved around all sheaves 48,49. Umbilical cable 16, in the illustrated embodiment, is an electromechanical cable and the end thereof is mechanically and electrically connected to one end of an electrical connector 58 secured through an opening 59 provided in end plate 32. The other end of electrical connector 58 is electrically connected, via electrical lead 60, to an electric connector 61 in electrical communication with electric circuit 65 contained within payload 25.

As mentioned hereinbefore, a buoyancy and mass module 27 is supported by payload 25 or by unit 20, or both, and encases a portion of motion compensation and tension control unit 20. In the illustrated embodiment, a portion of housing 29 of motion compensation and tension control unit 20 is received within an end of payload housing 69. A suitable connection ring 66, such as a weld connection, secures module 27 and motion compensation and tension control unit 20 to payload 25. Buoyancy and mass module 27 is provided with a compartmented exterior housing 67 containing multiple blocks or pads of buoyancy syntactic foam 68. This syntactic buoyancy foam is formed of hollow glass or plastic microspheres bonded together into unit blocks that may be cut to the desired size, and is commerically available as "Syntactic Foam" from Syntech Materials, Inc.

When additional mass and less buoyancy is desired, the buoyancy foam blocks are omitted from some of the compartments in module 27 and these compartments then become filled with the surrounding sea water to add mass to the structure. In some instances separate buoyancy and separate mass modules are employed for separately supplying buoyancy and mass to the system. As used herein the term "buoyancy and mass module" is intended to include a module containing at least some buoyancy material but may also include some compartments that fill with water to provide additional mass to the system.

Figure 4:
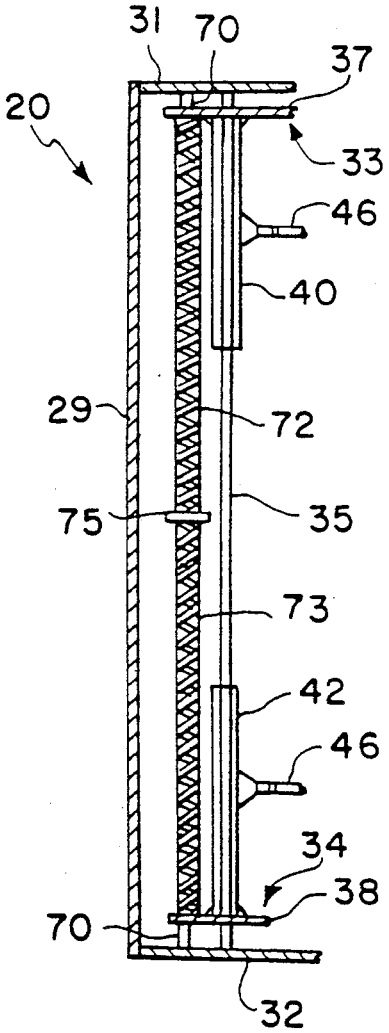
FIG. 4 is a part sectional, part schematic view of a portion of a motion compensation and tension control device similar to that shown in FIG. 2 but employing a different spring restraint system.

Referring now to FIG. 4, a portion of a motion and tension control device 20 illustrating a modified spring restraint system for sheave carriages 33,34, is shown. Payload 25, buoyancy and mass module 27, and other parts that are identical to that shown in FIG. 2 are omitted in this FIG. in the interest of brevity. Sheave support carriages 33 and 34 are of identical construction to that shown in FIG. 2 except for the orientation thereof. In this embodiment cross plates 37,38 are disposed adjacent respective end plates 31,32 and integrally secured slide tubes 40,42 (as well as 41,43 not shown) extend toward each other instead of extending toward end plates 31,32. The sheave and umbilical cable arrangement about axles 45,46 are identical to that described hereinbefore in reference to FIGS. 2 and 3.

In this embodiment, four spring guide rods are secured at each end to end plates 31,32 and support four compression springs disposed at each end of housing 29 for each carriage 37,38. These four compression springs are arranged in a rectangular pattern essentially indentical to that shown for springs 52,53,54,55 in FIG. 3. Only one spring guide rod 70 and two compression springs 72,73 are visible in FIG 4, it being understood that the remaining three spring guide rods and six compression springs are identical to those shown. A spring retention plate 75 is welded or otherwise conventionally secured at substantially the intermediate length of spring guide rod 70, and the others, not shown. Compression spring pair 72,73 each have one end thereof abutting spring retention plate 75 with the other end secured to and abutting respective cross plates 37,38 of carriages 33,34. Identical spring retention plates are also provided on each of the other spring guide rods to restrict the movement of the respective spring pairs thereon.

Figure 5:
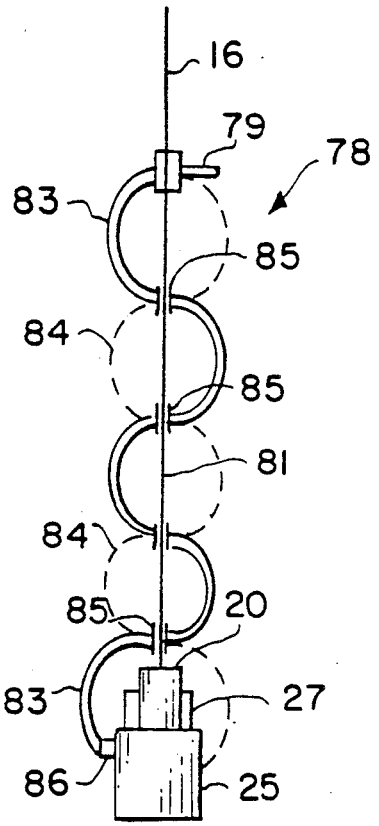
FIG. 5 is a part schematic view of a modified umbilical cable connection for the motion compensation and tension control device shown in FIGS. 1–4.

Referring now to FIG. 5 a modified umbilical cable connection for the motion compensation and tension control device 20 is shown and designated generally by reference numeral 78. As shown therein, umbilical cable 16 leading from the surface vessel (not illustrated in this FIG.) is received by a connector block or fitting 79. Electromechanical cable 16 is re-routed and exits connector block fitting 79 at substantially a ninety-degree angle. A separate strength support cable 81 is secured to connector block fitting 79 and leads into motion compensation and tension control unit 20 to the contained sheaves therein, as in the previously described embodiments. The portion of cable 16 extending from fitting 79 is a continuous length, disposed in a plurality of serpentine segments, and provided with a plurality of spaced slide members 85 attached along the length thereof and positioned between each of these segments.

Slide members 85 are slidably positioned onto strength support cable 81, as illustrated, to permit extension and contraction of the serpentine segments along electromechanical cable 16, as needed, during movement of strength support cable 81 into and out of motion compensation and tension control unit 20. An equal number of dummy or non-conductive serpentine cable segments 84 (shown in dotted line) are optionally connected to slide members 85 for balance or offset of any unbalanced moments created on strength support cable 81 by conductive cable segments 83. The serpentine portions 83 of electromechanical cable 16 terminate in a mechanical and electrical connection with an electrical connector 86 positioned on the side of payload 25. Electrical connector 86 extends through the sidewall or housing of payload 25 to connect with an electric circuit therein (not shown).

The umbilical cable connection embodiment of FIG. 5 is employed when large diameter electromechanical cables are required. It is desirable to minimize the ratio of cable diameter to sheave diameter or, stated differently, to maximize the ratio of sheave diameter to cable diameter. Thus, to avoid the use of extremely large sheaves and, to reduce the size of the motion compensation and tension control unit 20, umbilical cable 16 is re-routed to permit complete by-passing of the sheave assembly by the electrical conducting portion of the cable in the embodiment illustrated in this FIG.

Figure 6:
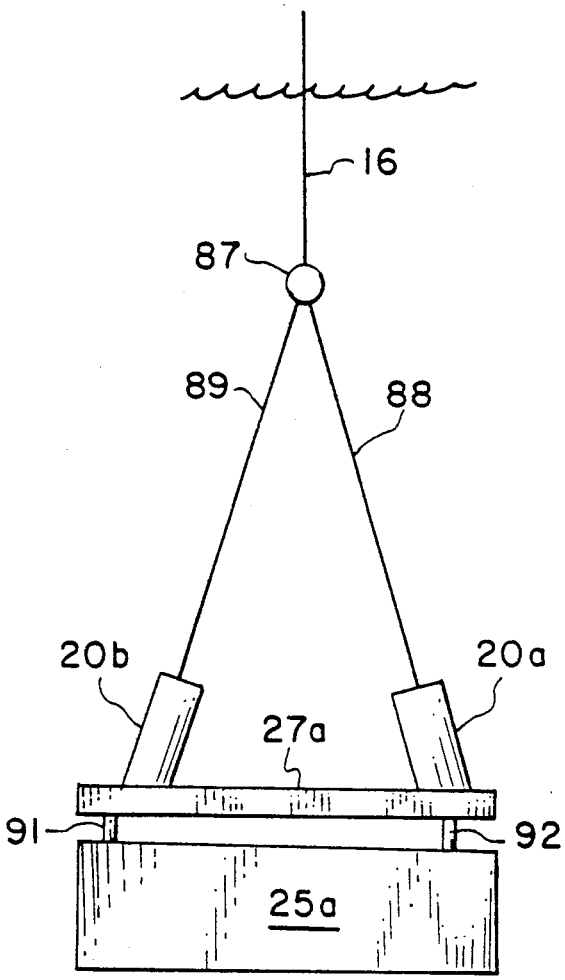
FIG. 6 is a schematic view of an application of two motion compensation and tension control devices as employed in deploying or lifting a heavy and/or bulky payload.

Referring now to FIG. 6, when extremely bulky or heavy payloads are to be deployed or lifted, umbilical cable 16, which in this embodiment may be purely mechanical, terminates in a cable connection ring or element 87. At least a pair of connecting cables 88,89 extend from cable connection element 87 to connect with spaced areas of the payload through separate motion compensation and tension control units **20*a* and 20*b*. Units 20*a* and 20*b* are essentially identical to and operate in the same manner as unit 20 described hereinbefore in reference to FIG. 2. A single modified buoyancy and mass module 27*a* is connected to each of units 20*a* and 20*b* and to the large mass payload 25*a*. Buoyancy and mass module 27*a* is attached to payload 25*a* via connecting elements 91,92**.

Figure 7:
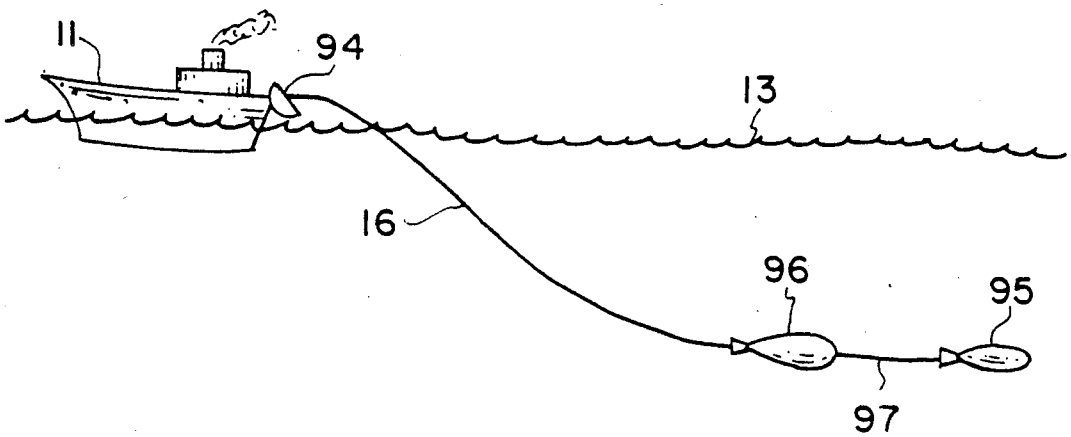
FIG. 7 is a schematic view of a ship towed sonar fish payload employing the motion compensation and tension control device of the present invention.

Referring now to FIG. 7, a surface vessel having an overboarding mechanism 94 thereon is schematically shown towing a sonar fish or similar payload 95. In this embodiment, a motion compensation and tension control unit contained in a streamlined housing 96 is employed to minimize surge motions on the towed payload 95. The contents and operation of the motion compensation and tension control unit within streamlined housing 96 is the same as that described hereinbefore in reference to FIGS. 2-4. In this embodiment a separate cable 97 provides positive connection between the end of housing 96 and payload 95.

Figure 8:
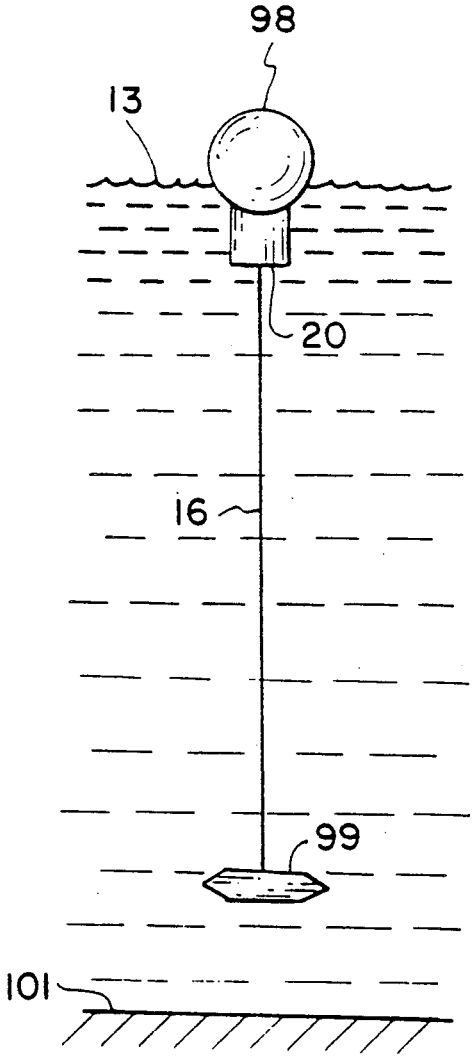
FIG. 8 is a schematic view of a surface buoy supporting a hydrophone or similar scientific payload and employing the motion compensation and tension control device of the present invention.

Referring now to FIG. 8 a motion compensation and tension control unit 20 is shown attached to a surface buoy 98, with umbilical cable 16 leading therefrom secured to and maintaining payload 99 above the sea floor 101. In this embodiment, payload 99 is a hydrophone or other suitable scientific package. The motion compensation and tension control unit 20 in this embodiment is inverted from that of the previously described embodiments and is fixed directly to buoy 98 with umbilical cable 16 extending to and secured to payload 99. Any wave induced motion of buoy 98 is transmitted directly to unit 20. Wave induced movement of payload 99 must be transmitted through umbilical cable 16. Since umbilical cable 16 acts on the spring restrained sheave carriages within the motion compensation and tension control unit 20, wave induced motion transmitted to payload 99 is nullified or, at least, minimized.

The operation of the invention is now believed apparent. Any surface or wave induced motion to the surface vessel or buoy causes corresponding paying out or retraction of the umbilical cable relative to the payload. By proper design of the buoyancy and mass modules, the moveable sheave system and the spring assemblages in the motion compensation and tension control unit 20, the suspended payload is held to a near motionless state in the water column. This is because paying out or retraction movement of the umbilical cable is transmitted to the identical sheave support carriages which move as rigid bodies along the guide rods but under elastic restraint by the elongated coiled springs in both the expansion and compression embodiments. When a force increase is directed to the umbilical cable 16 by an upheaval wave force on the surface vessel, this force causes carriages 33,34 to be pulled toward each other against the force of the restraint springs. When the wave motion dips or causes a reduced force on umbilical cable 16, the spring members exert a force on the umbilical cable through the cable sheaves 48,49 to take up impending slack in umbilical cable 16 without causing or permitting any appreciable motion being imparted to the payload, and without permitting any slack to occur in the umbilical cable.

Thus, as the surface vessel rises and falls in response to wave motions, so does the umbilical or suspension cable except for that portion of the cable reeved around the sheaves in the motion compensation and tension control unit 20. Due to the mechanical advantage provided by the sheaves, and proper relationship between system mass, the effective spring rate (Ke), and the average period of ship oscillation, the sliding carriages 33,34 will move only a fraction of the movement experienced by that portion of umbilical cable 16 external to unit 20. This results in reduced motions of the unit 20 and attached payload 25 compared to the motions of umbilical cable 16 and ship 11.

The effective spring rate (Ke) of the motion compensation and tension control unit, when properly selected, leads to a natural frequency of the total system which detunes or decouples the system from the motion of the surface vessel. The effective spring rate (Ke) is given by the equation $Ko/2N^2$ where Ko is the spring rate of a single carriage as provided by the coiled springs in combination with each other and N represents the total number of sheaves. The natural frequency of the system is given by $$\omega_n = \sqrt{Ke/M}$$

where M is the total submerged mass, including the combined mass of the flooded motion compensation and tension control unit 20, the buoyancy and mass module 27 and the payload 25, including virtual mass. For effective detuning from wave induced vessel motion, the natural frequency of the submerged system should be approximately one-third of the frequency of the vessel motion.

Stated differently, the cable passing through opening 56 in end plate 31 has motion or displacement relative to the body of the motion compensation and tension control unit equal to 2N times the displacement of each carriage 33, 34. For example, if each carriage 33, 34 moves ten inches along the guide rods 35, 36, the length of cable 16, played out or hauled in, depending on whether the carriages 33, 34 approach each other or move away from each other, will be 200 inches when each carriage has five sheaves. Therefore, for the motion of the motion compensation and tension control unit 20 to be compatible with the external portion of the umbilical cable 16, the absolute movement of unit 20 itself, must be considerably reduced in comparison to the movement of the external portion of cable 16. Such described action will occur as long as the effective spring constant Ke, and the total submerged mass are properly related to the average frequency of ship motion as stated hereinbefore.

A common cause of cable snap loads is a low value of free-fall velocity for the submerged payload. For example, if the top portion of the umbilical cable 16 adjacent the ship is moving downward at a velocity in excess of the free-fall velocity of the submerged payload, the distance between the top and bottom portions of the suspension cable must be reduced, possibly to the point where the cable goes slack. Then, when the ship begins to rise again, the cable becomes taut, possibly to the point where it is over-stressed and breaks. The motion compensation and tension control unit 20 of the present invention hauls in the portion of cable 16 tending to become slack, and thereby controls the tension of cable 16 and prevents slack cable and snap load breaks in the cable.

As mentioned hereinbefore, motion compensation and tension control unit 20 is adapted to become flooded with sea water when in use and thus, the components thereof must be constructed of materials that are non-corrosive when exposed to sea water for extended periods of time. Suitable materials for this purpose include, but are not limited to, stainless steel, aluminum, aluminum alloys and various plastics. Payload 25 may also be flooded or housing 69 thereof may be entirely, or have portions thereof, sealed against flooding by suitable structure (not shown).

It is thus seen that the present invention provides a reliable and valuable motion compensation and tension control system for submersible payloads that are cable supported by a surface vessel or buoy.

Although the invention has been described relative to specific embodiments thereof, it is not so limited and there are numerous variations and modifications of the invention that will be readily apparent to those skilled in the art in the light of the above teachings. For example, although the umbilical cable 16 has been described as being an electromechanical cable in some of the specific examples herein, other cable supports are considered within the scope of the present invention. In this respect, when no communication is required between the surface vessel and payload, umbilical 16 may be constructed of synthetic or wire rope. Also, optomechanical cables may be employed as umbilical cables 16 when electrical communication is not needed and the use of fiber optic communication is desired between the surface vessel and the payload.

Although the buoyancy and mass module 27 has been shown as positively connected to the payload housing 69 of payload 25 and housing 29 of motion compensation and control unit 20, the invention is not so limited. Module 27 may be attached to housing 29 alone, and supported solely by motion compensation and tension control unit 20, if so desired. Also, module 27 may be attached only to housing 69 of payload 25 and supported solely by payload 25, if so desired. In addition, separate buoyancy modules and/or separate mass modules may be employed when the size, shape or mission of the payload employed so dictates.

Further, although the specific examples described herein show the use of four springs for each sheave carriage in both the tension and compression embodiments, the invention is not so limited. Two springs for each sheave carriage may be employed in some instances with each of these springs being employed on opposite ends of the cross plates. There may also be some applications that would operate more efficiently with an excess of four springs on each sheave carriage.

In lieu of the serpentine arrangement employed in the embodiment of FIG. 5, the by-pass or re-routed electromechanical cable 16 portion may be formed in the shape of a helix linearly disposed about the strength support cable 81 and thus avoid the use of slide members 85 and omit, or limit, any contact with strength support cable 81. In this application, a modified electrical connection would be employed between electromechanical cable 16 and payload 25.

Further, in the embodiment of FIG. 8, motion compensation and tension control unit 20 may also be located adjacent payload 99 as in the previously described embodiments or may be positioned at any location between surface buoy 98 and payload 99. Also, although not shown, mass and buoyancy modules may be employed in this embodiment and attached to cable 16, as so desired.

An alternate to the sheave carriage system specifically described herein for paying out and hauling in cable 16, could involve the use of a single large diameter, shaft supported, sheave. In this application the end of cable 16 would be attached to and wrapped around the single sheave. A separate cable and spring system attached to the sheave shaft and housing would, upon rotation of the sheave and attached shaft, cause an increase or decrease in tension of the spring.

It is therefore to be understood that, within the scope of the appended claims, the invention may be practiced other than as specifically described herein.

What is claimed as new and desired to be secured by Letters Patent of the United States is:

1. A motion compensation and tension control system for a submersible payload supported by an umbilical cable extending from an overboard mechanism disposed on a surface vessel comprising:

a housing having a first and a second end plate disposed on opposite ends thereof;

a pair of axles disposed in spaced transverse relationship within said housing;

a plurality of spaced sheaves rotatably supported by each of said pair of axles;

axle support means permitting relative slidable movement of said axles toward and away from each other within said housing;

spring means disposed within said housing and serving to resist relative movement of said axles toward each other and to assist relative movement of said axles away from each other;

an umbilical cable opening disposed through said first end plate;

an umbilical cable having one end thereof received through said umbilical cable opening;

said umbilical cable having another end connected to an overboarding assembly disposed on a surface vessel;

said end of said umbilical cable received through said umbilical cable opening being reeved around each of said plurality of spaced sheaves on each of said pair of axles and extending from said plurality of sheaves;

mechanical connection means disposed on and mechanically securing said umbilical cable to said second end plate disposed on the opposite end of said housing from said first end plate receiving said umbilical cable; and means for securing said housing to a submersible payload.

2. The motion compensation and tension control system as in claim 1 wherein said axle support means includes;

a pair of elongated spaced guide rods extending between and secured to each of said first and said second end plates;

a pair of cross plates disposed in spaced relation and extending substantially across said housing;

a pair of elongated slide tubes integrally secured to each of said pair of cross plates;

each of said cross plates and each of said slide tubes being slidably supported by said elongated spaced guide rods; and each of said pair of elongated slide tubes having one member of said pair of axles integrally secured thereto.

3. The motion compensation and tension control system of claim 1 wherein:

said umbilical cable is an electromechanical cable;

said mechanical connection means including an electrical receptacle attached to and extending through said end plate having said umbilical cable secured thereto; and said electromechanical cable being secured in electrical connection to said electrical receptacle.

4. The motion compensation and tension control system of claim 3 wherein:

said means for securing said housing to a submersible payload includes both mechanical and electrical connections serving to mechanically and electrically connect a submersible payload to said housing.

5. The motion compensation and tension control system of claim 1 including:

a submersible payload having a housing;

a portion of said submersible payload housing being fixedly secured to said housing of said motion compensation and tension control system by said means for securing a submersible payload to said housing;

an electrical circuit contained within said submersible payload housing;

said umbilical cable being an electromechanical cable;

said mechanical connection means including an electrical receptacle attached to and extending through said second end plate and having said umbilical cable mechanically and electrically connected thereto;

electrical connector means connecting said electrical receptacle with said electrical circuit in said submersible payload housing.

6. The motion compensation and tension control system of claim 5 including:

at least one buoyancy and mass module surrounding a portion of said housing having said first and said second end plates disposed on opposite ends thereof, said buoyancy and mass module being also supported by said housing of said submersible payload.

7. The motion compensation and tension control system of claim 6 wherein said at least one buoyancy and mass module is provided with a perforated housing having multiple compartments therein and including individual blocks of syntactic foam disposed within at least some of said multiple compartments.

8. The motion compensation and tension control system of claim 1 including:

a submersible payload having a housing;

said umbilical cable being an electromechanical cable;

a connector block receiving and secured to said umbilical cable wherein said umbilical cable is received by an end of said connector block and having a length thereof re-routed and angularly extending from a side of said connector block;

a strength support cable secured to and extending directly from said connector block and effectively becoming an extension of said umbilical cable;

a plurality of spaced slide members disposed on said strength support extension of said umbilical cable;

said length of said electromechanical cable re-routed and angularly extending from said connector block being disposed in a plurality of serpentine sections and connected in sequence to said plurality of spaced slide members;

a terminal segment of said electromechanical cable being provided with an electrical connector;

a payload electrical connector disposed on said housing of said submersible payload;

said electrical connector on said terminal segment of said electromechanical cable being electrically connected to said payload electrical connector; and said payload electrical connector being in electrical connection with an electric circuit carried by said submersible payload.

9. The motion compensation and tension control system of claim 1 wherein:

said umbilical cable is selected from the group of cables consisting of mechanical, electromechanical and optomechanical cables.

10. A motion compensation and tension control system for a submersible payload suspended in a sea of water by an umbilical cable extending from a surface vessel, comprising:

an elongated housing having first and second spaced end plates;

a pair of elongated spaced carriage guide rods extending between and secured to each of said first and said second end plates;

a sheave support carriage disposed within said housing adjacent each of said first and said second end plates;

each of said sheave support carriages including a cross plate transversely extending across said housing;

each said cross plate having openings therein receiving said pair of elongated spaced guide rods;

a pair of elongated slide tubes secured to each of said cross plates about the openings therein and slidably received by said pair of spaced carriage guide rods;

an axle transversely disposed between each of said pair of elongated slide tubes;

a plurality of spaced sheaves rotatably supported by each said axle;

spring means restricting the slidable movement of said sleeve support carriages along said carriage guide rods;

an umbilical cable opening disposed through said first end plate;

an umbilical cable extending through said umbilical cable opening; and said umbilical cable being reeved over each of said sheaves and mechanically attached to said second end plate.

11. The motion compensation and tension control system of claim 10 wherein said spring means restricting the slidable movement of said sheave support carriages along said carriage guide rods includes at least a pair of elongated tension springs, each of said elongated tension springs having a first end connected to one of said end plates and a second end connected to one of said cross plates.

12. The motion compensation and tension control system of claim 10 wherein said spring means restricting the slidable movement of said sheave support carriages includes at least a pair of spaced spring guide rods extending between and secured to each of said spaced end plates;

each of said spring guide rods being slidably received by each said cross plate of said sheave support carriages and including a transverse stop plate secured to the approximate intermediate length thereof;

said cross plates of said sheave support carriages being disposed adjacent and between said pair of elongated slide tubes and said end plates; and an elongated compression spring disposed on each of said spaced spring guide rods and having respective end portions abutting one of said cross plates of one of said sheave support carriages and one of said transverse stop plates on said spring guide rods.

13. The motion compensation and tension control system of claim 10 wherein said spring means restricting the slidable movement of said sheave support carriages along said carriage guide rods includes at least a pair of elongated tension springs;

said cross plates of said sheave support carriages being spaced from said end plates;

said elongated slide tubes secured to each of said cross plates being disposed between an end plate and one of said cross members; and said at least a pair of elongated tension springs each having a first end secured to one of said end plates and a second end secured to one of said cross plates.

14. The motion compensation and tension control system of claim 10 including a submersible payload secured to said elongated housing and wherein said umbilical cable extending through said umbilical cable opening is connected to a crane disposed on a ship; said umbilical cable being an electromechanical cable; an electrical connector element extending through said second end plate; said electromechanical cable being mechanically and electrically connected to said electrical connector element; and an electrical circuit in said submersible payload being disposed in electrical connection with said electrical connector element.

* * * * *